US007421986B2

(12) United States Patent
Yakhnis

(10) Patent No.: US 7,421,986 B2
(45) Date of Patent: Sep. 9, 2008

(54) ROTARY RADIAL INTERNAL COMBUSTION PISTON ENGINE

(76) Inventor: Leonid Yakhnis, St. Yad Lebanim 182/17, Haifa (IL) 32698

( * ) Notice: Subject to any disclaimer, the term of this patent is extended or adjusted under 35 U.S.C. 154(b) by 0 days.

(21) Appl. No.: 11/227,553

(22) Filed: Sep. 16, 2005

(65) Prior Publication Data

US 2007/0062469 A1 Mar. 22, 2007

(51) Int. Cl.

| | |
|---|---|
| ***F02B 57/00*** | (2006.01) |
| ***F02B 57/08*** | (2006.01) |
| ***F02B 57/06*** | (2006.01) |
| ***F02B 57/10*** | (2006.01) |

(52) U.S. Cl. ..... 123/43 R; 123/43 C; 123/44 D; 123/44 C; 123/44 R; 91/197; 91/491

(58) Field of Classification Search ..... 123/44 D, 123/44 C, 43 R, 44 B, 43 C, 44 R; 91/197, 91/491; *F01B 5/00, 9/04*

See application file for complete search history.

(56) References Cited

U.S. PATENT DOCUMENTS

| | | | | | |
|---|---|---|---|---|---|
| 351,986 | A * | 11/1886 | Lane | ..... | 123/44 B |
| 392,039 | A * | 10/1888 | Lane | ..... | 123/44 B |
| 641,034 | A * | 1/1900 | Peck | ..... | 123/44 B |
| 988,938 | A * | 4/1911 | Hubbard | ..... | 123/44 B |
| 1,341,328 | A * | 5/1920 | Lamplough | ..... | 91/197 |
| 1,776,843 | A * | 9/1930 | Schafer | ..... | 123/43 C |
| 2,990,820 | A * | 7/1961 | Saijo | ..... | 123/44 D |
| 3,270,723 | A * | 9/1966 | Maroney | ..... | 123/43 R |
| 4,166,438 | A * | 9/1979 | Gottschalk | ..... | 123/44 D |
| 4,177,771 | A * | 12/1979 | Nutku | ..... | 123/43 C |
| 5,967,102 | A * | 10/1999 | Huang | ..... | 123/44 D |
| 6,062,175 | A * | 5/2000 | Huang | ..... | 123/44 D |
| 6,536,383 | B2 * | 3/2003 | Santiyanont | ..... | 123/44 D |
| 2003/0154936 | A1 * | 8/2003 | Santiyanont | ..... | 123/44 D |

FOREIGN PATENT DOCUMENTS

| | | | |
|---|---|---|---|
| DE | 3730558 | A1 * | 3/1989 |
| EP | 391866 | A1 * | 10/1990 |
| RU | 2088762 | C1 * | 8/1997 |

* cited by examiner

*Primary Examiner*—Thai-Ba Trieu

(57) ABSTRACT

The engine comprises a housing, a rotor, which is mounted in the housing for rotation about its axis. The rotor has a pair radially opposite cylinders spaced radially and apart from its axis of rotation. A piston spaced in each of the cylinders. Gas intake and gas exhaust may take place through the ducts in the body of the rotor. There is a rotary ring mounted in the housing which rotates about its axis of rotation being parallel and spaced apart from the rotor axis. The rotary ring has been connected to the pistons for rotation therewith and being impelled to rotate in the same direction and with the same velocity relative to the rotor by pins of the rotor. The pressure in the cylinders acts on the rotor being eccentrical relative to the axis of rotation of the rotary ring and so affords power.

1 Claim, 4 Drawing Sheets

ROTARY RADIAL INTERNAL COMBUSTION PISTON ENGINE

BACKGROUND OF THE INVENTION

1. Field of the Invention

The present invention relates to the machine building and can be applied in the form of an internal combustion engine, a gas engine, a hydraulic motor, a gas compressor and a hydraulic pump 2. Description of the Related Art The Self-Supercharging Rotary Engine is the object of invention U.S. Pat. No. 3,270,723. The engine includes a stator, a circular cam track stationary mounted in the stator, a rotor mounted for rotation about its axis parallel to the cam track axis and spaced apart from it. The rotor is provided with a pair of cylinders being parallel and being displaced on opposite sides and at a set distance from the axis of rotation of the rotor. The rotor includes a piston assembly for each cylinder and fuel supply means. The power is generated in combustion chambers so as the pistons react against the stationary cam track and due to the eccentricity of the axis of rotation of the rotor as compared to the axis of rotation of the circular cam, there results rotary movement of the rotor.

The Rotary Engine is the object of invention U.S. Pat. No. 988,938. A rotary engine comprises a primary member including a plurality of fluid pressure operated pistons, piston rods, a shaft extending through the primary member, an annular member surrounding the primary member and having its axis parallel to and off-set with respect to the axis of the primary member, links disposed for securing the rotation of the annular member synchronously with the primary member. Said shaft extends through and supports the fluid delivery and exhaust member having the inlet and the exhaust chamber. Cylinders are receiving steam or other elastic fluid under pressure. The force of the outward driven pistons will be exerted rotatively The Steam-Engine is the object of invention U.S. Pat. No. 351,986. The engine consists of a rotary steam-cylinder mounted on a shaft, with a piston connected to another shaft of a rotary steam-cylinder mounted on a shaft, with a piston connected to another shaft out of line with but parallel to the cylinder shaft. The engine is provided with a suitable induction and exhaust passages. The cylinders receive and exhaust steam through ports in the hub. The pistons are connected to a wheel mounted on a shaft and are carried in their circular path about the shaft as a center. The connection keeps the parts in just relation to each other, the power being exerted by the piston-connections.

The Steam-Engine is the object of invention U.S. Pat. No. 392,039. The engine is a further improvement in the better operation of the Steam-Engine U.S. Pat. No. 351,986, and includes the leading features of the U.S. Pat. No. 351,986.

The Rotary Piston Engine is the object of invention RU U.S. Pat. No. 2,088,762. The rotary engine consists of a housing, a rotor mounted in the housing for rotation about its axis. The rotor has ducts for gas intake and gas exhaust, has cylinders spaced radially and apart from the axis of rotation of the rotor. A piston spaced in each of the cylinders for displacement along the respective cylinder axes. The engine has a rotary ring which runs on the thrust rollers mounted in the in housing cavities and rotates around its axis being parallel and spaced apart from the rotor axis. The rotary ring is connected to the pistons for rotation therewith. The engine has a synchronizer for the angular speeds of the rotor and rotary ring. The pressure in the cylinders is converted to an output shaft torque.

All of the above engines are rotary piston-type engines which have been adapted to be driven by compressed fluid (gas), and they have well-known advantages of engines of this kind:

- the high speed rate,
- the working parts revolve and there are no reciprocating parts.

It is declared, that the above engines may be used in the form of rotary internal combustion engine. Most of abovementioned engines had been invented more than 100 years ago but so far the four-strokes internal combustion crankshaft one which operates according to the Otto cycle is a conventional engine.

The problem is in the disadvantages of design of the abovementioned engines (inventions):

- the design of all the above engines has too complex and too weak a structure,
- the engines, as being described above, have been designed such that they cannot be applied in the form of four-strokes internal combustion engine which operates according to the Otto cycle.

All of above disadvantages are impossible to overcome by modifying the design of the abovementioned engines.

BRIEF DESCRIPTION OF THE SEVERAL VIEWS OF THE DRAWING

The invention would be described now with reference to the.

DETAILED DESCRIPTION OF THE INVENTION

Figure 1:
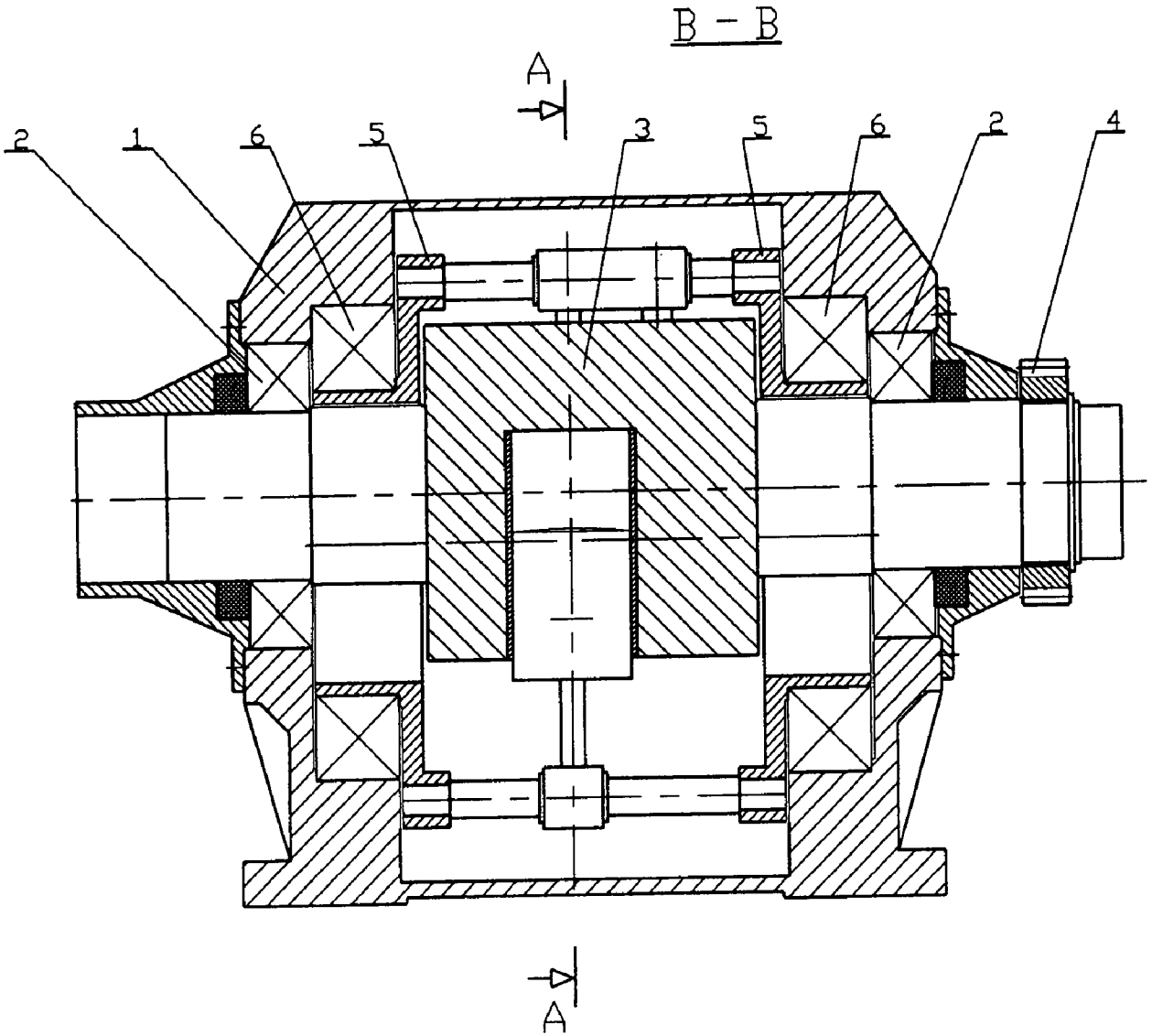
FIGS. 1,2 illustrate the construction of the engine and a manner in which it operates.
Figure 2:
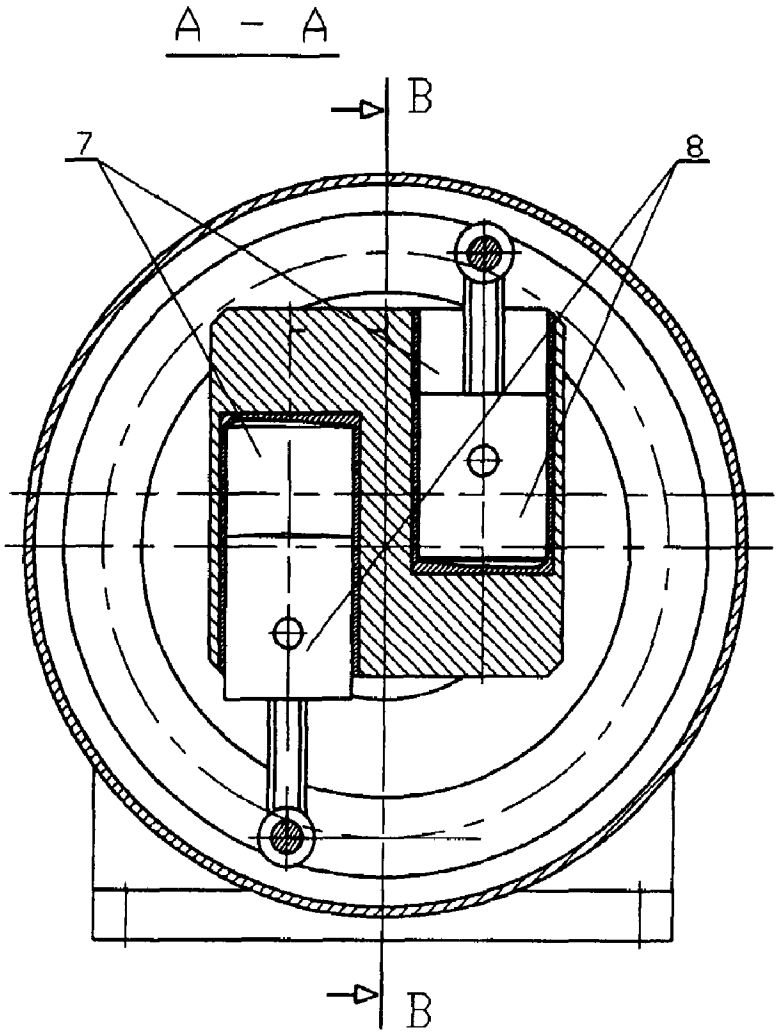
Figure 3:
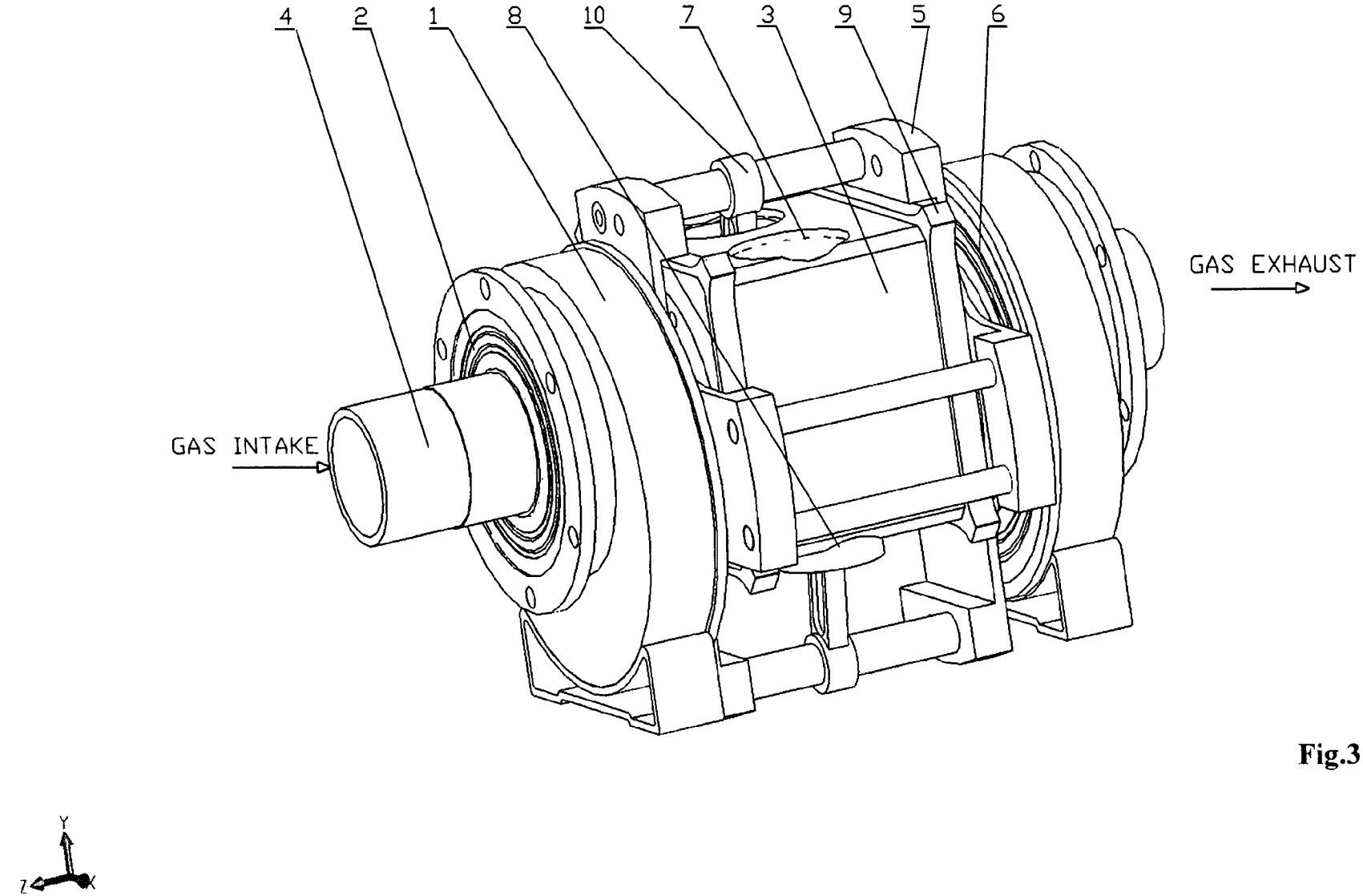
FIG. 3 is isometric view of engine.
Figure 4:
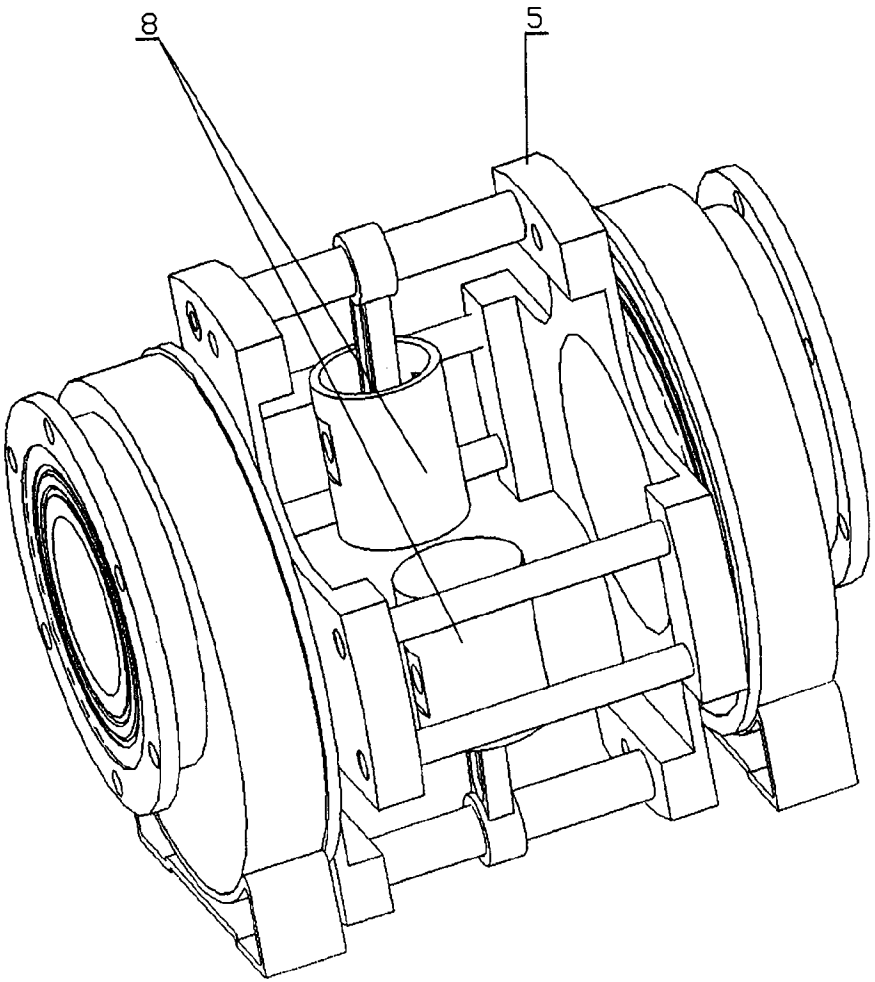
FIG. 4 corresponds to FIG. 3 in greater detail.

Turning first to FIGS. 1-2:

New engine comprises a housing (1), a rotor (3) having a driven shaft (4) fastened thereon, which is mounted on the bearings (2) spaced coaxially apart in the opposite sides of the housing and rotates about its axis of rotation and has a pair radially opposite cylinders (7) spaced in the body of the rotor eccentrically and equidistantly relative to its axis of rotation. One radially outer end of each cylinder is closed by the wall and the other end is closed by piston (8) which slides within the cylinder. Gas intake and gas exhaust may take place through the ducts in the body of the rotor extending from the cylinders to the inner pipe port of the driven shaft. There is a rotary ring (5) mounted on the bearings (6) spaced coaxially apart in the opposite sides of the housing. It rotates about its axis of rotation spaced apart from the rotor axis by an eccentricity and being impelled to rotate in the same direction and with the same velocity relative to the rotor by pins (9), (FIG. 3) of the rotor. The pistons are connected to the rotary ring through the connecting rods (10), (FIG. 3).

In general operation of the engine, while the housing remains stationary, the rotor with cylinders, pistons, connecting rods and the rotary ring rotate in the same direction and with the same velocity about the rotor and the rotary ring axes of rotation correspondently. The above axes are not coaxial and therefore both the piston and the cylinder slide with respect one to another. Both the cylinders and the pistons are impelled by gas under pressure. One way the pressure acts through the pistons and connecting rods to the rotary ring and through the bearings of the rotary ring to the housing. Another way it acts through the cylinders (the bottom walls of the cylinders) to the rotor and to the driven shaft being eccentrical relative to the axis of rotation of rotory ring and so affords power.

The invention claimed is:

1. A Rotary Radial Internal Combustion Piston Engine comprises a housing (1), a rotor (3) having a driven shaft (4) fastened thereon, a first set of bearings (2), wherein said driven shaft (4) mounted on, spaced coaxially apart on the opposite sides of said housing (1) for rotation about an axis of said rotor (3), a rotary ring (5), a second set of bearings (6) wherein said rotary ring (5) mounted on, spaced coaxially apart on the opposite sides of said housing (1) for rotation around an axis of said rotary ring (5) being parallel and spaced apart from axis of said rotor (3), a pair radially opposite cylinders (7) spaced in the body of the rotor (3) eccentrically and equidistantly relative to said rotation axis of said rotor (3), a piston (8) spaced in each of said cylinders for displacement along the respective cylinder axes, wherein said piston (8) is connected respectively to said rotary ring (5) by connecting rods (10), an intake duct being at an outer end of said driven shaft (4) and an exhaust duct being at an opposite outer end of said driven shaft (4), an inner pipe connecting said intake duct to said cylinders (7) and said cylinders (7) to said exhaust duct, and pins (9);

wherein said rotary ring (5) is eccentrically relative to the rotation axis of said rotor (3), and is impelled to rotate in the same direction and at the same velocity relative to said rotor by the direct mechanical connection between said rotor and said rotary ring by said pins (9) of said rotor.

* * * * *